United States Patent [19]

Collins

[11] 4,266,764

[45] May 12, 1981

[54] RECREATIONAL BASKETBALL APPARATUS WITH MOVING GOAL

[76] Inventor: Andrew P. Collins, 3926 Dover Rd., Durham, N.C. 27705

[21] Appl. No.: 120,613

[22] Filed: Feb. 11, 1980

Related U.S. Application Data

[62] Division of Ser. No. 829,987, Sep. 1, 1977, Pat. No. 4,202,543.

[51] Int. Cl.[3] ..... A63J 3/00; A63B 63/06

[52] U.S. Cl. ..... 272/3; 273/1.5 R; 273/354

[58] Field of Search ..... 272/3; 273/1.5 R, 1.5 A, 273/29 A, 317, 359, 368, 176 B, 354

[56] References Cited

U.S. PATENT DOCUMENTS

| | | | |
|---|---|---|---|
| 264,416 | 9/1882 | Reynolds | 273/368 |
| 2,130,820 | 9/1938 | Trumbull | 273/1.5 R |
| 3,103,362 | 9/1963 | Elofson | 273/359 |
| 3,477,714 | 11/1969 | Garlington | 273/1.5 R |
| 3,588,103 | 6/1971 | Fuller | 273/1.5 R |
| 3,602,504 | 8/1971 | Chapman et al. | 273/1.5 R |
| 3,703,289 | 11/1972 | Hohman | 273/368 X |
| 3,794,318 | 2/1974 | Holmes | 273/354 X |
| 3,958,806 | 5/1976 | Brown | 273/368 X |

FOREIGN PATENT DOCUMENTS

| | | | |
|---|---|---|---|
| 976896 | 11/1950 | France | 273/368 |
| 618199 | 2/1961 | Italy | 273/1.5 R |
| 220449 | 11/1924 | United Kingdom | 273/368 |

*Primary Examiner*—Anton O. Oechsle
*Assistant Examiner*—Arnold W. Kramer
*Attorney, Agent, or Firm*—B. B. Olive

[57] ABSTRACT

A facility intended for use on a commercial basis, both for recreational and amusement purposes, offers a plurality of basketball-like courts designed to be played in sequence and with each court having a different challenging situation at least one of which utilizes a backboard having a vertical goal mounted on a rotating horizontal shaft which shaft is perpendicular to the backboard and a motor to rotate the shaft so as to present the goal in a periodically recurring normal basketball position for passage of the ball therethrough.

1 Claim, 19 Drawing Figures

RECREATIONAL BASKETBALL APPARATUS WITH MOVING GOAL

CROSS-REFERENCE TO RELATED APPLICATION

This application is a division of copending application Ser. No. 829,987, entitled RECREATIONAL BASKETBALL COURT FACILITY, filed Sept. 1, 1977, and now U.S. Pat. No. 4,202,543.

BACKGROUND OF THE INVENTION

1. Field of the Invention

This invention relates to recreational facilities and more particularly to basketball-type facilities designed for commercial use.

2. Description of the Prior Art

Various commercial recreational facilities involving individual participation are gaining in popularity. Such facilities are often found at resort, beach and vacation areas and there appears to be a need for continuing and even expanding well-established types of commercial recreational facilities, such as in the case of miniature golf, as well as inaugurating new types of commercial recreational facilities involving individual participation as exemplified in the recently-started skateboard facilities.

The amount of land required for any type of commercial recreational facility becomes a prime consideration in view of increasing land prices. Where courts are required, it becomes desirable to minimize the amount of land required for the facility and it is known to have multiple recreational courts in a close arrangement as illustrated in U.S. Pat. Nos. 3,858,880 and 3,948,512. Another type of plural court arrangement for playing a basketball-type game is also shown in U.S. Pat. Nos. 3,388,909 and 3,544,109.

In the ordinary basketball game as played on the ordinary basketball court, it can be observed that any variation in challenge to the player normally comes about by the group action. Thus, to simply offer a reproduced conventional basketball court as a recreational facility would not offer a constantly changing challenge to the individual player playing solely for enjoyment and recreation. While conventional basketball goals and backboard constructions have sometimes been modified as in U.S. Pat. No. 3,910,575, such modifications have been primarily arranged for some specific training purpose such as improving the ability to shoot the ball into the basket.

While other prior art practices might be mentioned, the prior art has not provided a commercial basketball-type facility designed for individual participation and in which the participant is given the opportunity to play a plurality of courts in sequence and with each court offering a different challenge and, in some cases, a reward for meeting a particularly difficult challenge.

SUMMARY OF THE INVENTION

The recreational basketball court facility of the invention in a preferred embodiment involves the construction of several sets of radially arranged plural courts which the participant plays in sequence. Each court provides a different shooting challenge and which is achieved in different ways from court-to-court such as by changing the size or shape of the goal, changing the shooting stance required of the participant, providing motion to the goal structure or to the backboard structure or to both and in some instances about a vertical axis and in other instances about different orientations of the horizontal axis. The present invention is more specifically directed to such a facility having at least one such unique goal-backboard structure having the goal mounted on a shaft member rotatable about a horizontal axis perpendicular to the plane of the backboard and means to rotate said shaft so as to present said goal in a periodically recurring normal position for passage of the ball therethrough as seen in FIG. 4. FIGS. 2–3 and 5–19 illustrate other challenges not claimed herein.

DESCRIPTION OF THE PREFERRED EMBODIMENT

In accordance with the embodiment chosen for illustration, a commercial recreational facility comprises sets of plural basketball courts and four such sets of courts are shown for illustration. Within each set of courts, the courts have a radial arrangement and each individual court presents a different playing challenge by means later described.

Figure 1:
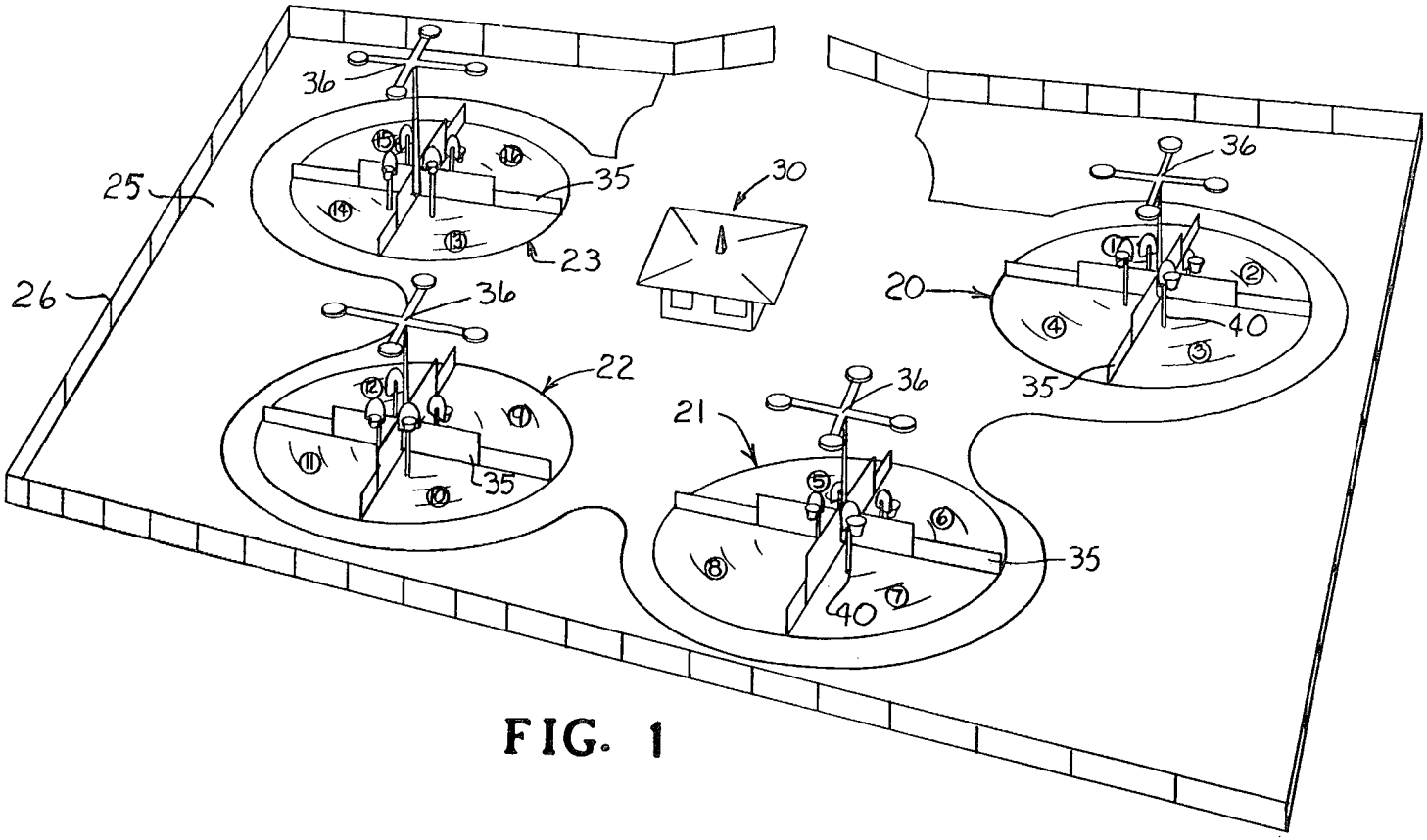
FIG. 1 is a perspective view of a commercial basketball recreational facility constructed in accordance with the present invention.

Referring more particularly to FIG. 1 of the drawings and to the embodiment used for illustration, four sets of courts 20–23 are shown within a common rectangular land area 25 bounded by a fence 26. An appropriate ticket house 30 is centrally located and it is at this location at which the individual participants are given appropriate scorecards and instructions for playing the various courts in sequence after paying the appropriate fee. Sixteen courts are shown for illustration and are identified by the encircled numbers 1–16. The courts are separated by appropriate fencing 35 and are illuminated at night by the light fixtures 36.

Each court is essentially wedge-shaped and the four courts of each set of courts illustrated emanate from a common central point with the goal-backboard support post 40 being placed outwardly from the central point in each court.

Prior to describing the invention in more detail, it may be noted that basketball, as traditionally played, is a team game played by groups on a court with one basket of regulation size and height at each end of the court. The climax of any play is taking the shot and making the basket which scores points. The main challenge for the player shooting the ball is the action of defensive players.

In contrast with the conventional game of basketball, the present invention is intended to provide basketball recreation on a commercial basis where players shoot the basketball in different challenging situations. These challenges are provided in a variety of ways differing substantially from the type of challenge afforded the player in the conventional basketball game. As later described, the challenges in some instances come from different shaped baskets differing from the traditional hoop shape. In other instances, motion of the basket or the basket and backboard as a unit provides the challenge. In still other instances, movable and stationary barriers in front of the basket provide the challenge. In addition to scoring points in the recreational facility of the invention, the players are in some instances rewarded for shots they make by sound and sight devices which are activated as the ball passes through the goal and net.

Another feature of the recreational court facility of the invention is afforded by a handicap system. At each court location, there are preferably three or more lines for shooting which are at variable distances from the basket. Younger and more inexperienced players may shoot from the line closest to the basket whereas lines which are progressively more distant from the basket are provided for players who feel that they need a greater challenge. A handicap system is also present in the size of the ball that is used. Larger and more experienced players use the standard or official size basketball whereas younger, smaller and more inexperienced players may shoot with a junior size basketball which is lighter and smaller in diameter.

While any of the various devices used to provide variety in the challenges presented the player may be used in any court and in any sequence desired, the devices illustrated by FIGS. 2–19 indicate some of the configurations available to carry out the purposes of the invention and which are next described.

Figure 2:
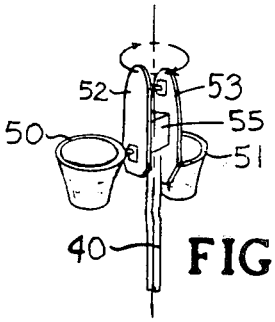
FIG. 2 is a perspective view and FIG. 3 is a plan view illustrating a goal-backboard arrangement in which two goals are mounted in opposed position on backboards positioned back-to-back and where the goals and backboards revolve together around a common vertical axis.
Figure 3:
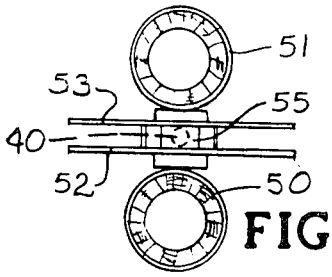

FIGS. 2 and 3 represent respectively a perspective and plan view of a goal-backboard arrangement in which the goals 50, 51 are made of regulation size and are mounted in opposed positions on back-to-back arranged backboards 52, 53, also of regulation size. A suitable drive motor and drive mechanism 55 is appropriately mounted on support post 40 and causes the double goal-backboard arrangement to continuously rotate. The drive mechanism 55 may be similar to that employed for rotating advertising signs, and the like. The FIG. 2 configuration, thus, provides an exciting challenge since the player can only make a successful basket in the interval of time when one of the goals 50 or 51 is present in the particular court in which the FIG. 2 configuration is mounted. The difficulty of this particular challenge can also be varied even further by speeding up or slowing down the drive mechanism 55 to make the challenge more or less difficult. The direction of rotation can also be periodically reversed for variety.

Figure 4:
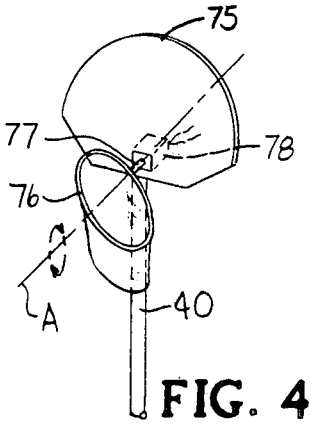
FIG. 4 is a perspective view of a goal-backboard arrangement in which the goal rotates around an axis perpendicular to the backboard.

In FIG. 4, a conventional backboard and goal are shown with the goal being mounted on a shaft 77 connected to a suitable motor drive 78 so as to cause goal 76 to rotate around the axis "A" of shaft 77 thus requiring the player to direct his ball through goal 76 during the limited time when the vertical axis of goal 76 is perpendicular with the shooting line.

Figure 5:
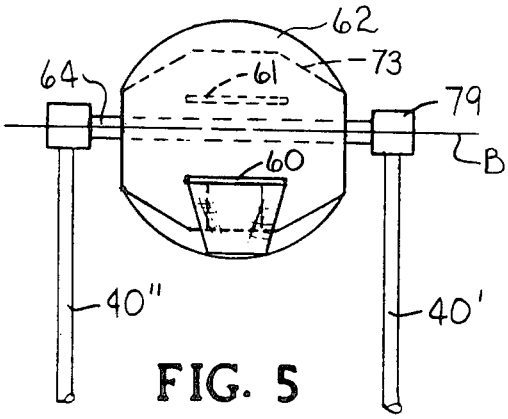
FIG. 5 is a front view and FIG. 6 is a side view illustrating a goal-backboard arrangement in which two goals are mounted in opposed position on backboards positioned back-to-back and where the goals and backboards revolve together around a common horizontal axis.
Figure 6:
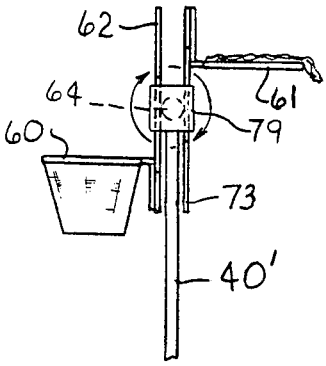

The respective front and side views of FIGS. 5 and 6 are intended to represent a goal-backboard arrangement in which the goals 60 and 61 are mounted on opposing ends of separate back-to-back backboards 62 and 73 with backboards 62 and 73 in turn being mounted on rotatable shaft 64 and where all of such structure is supported by support posts 40' and 40''. A suitable drive motor and drive mechanism 79 are provided to cause the double goal-backboard arrangement to continuously rotate about horizontal shaft 64 and axis "B". Since goals 60, 61 are constantly moving, the player must time his shot such that the ball meets one of the goals when in proper position for making a basket. The challenge can be varied in difficulty by speeding up or slowing down the drive mechanism 79 and/or by periodically reversing the direction in which shaft 64 is made to rotate.

Figure 7:
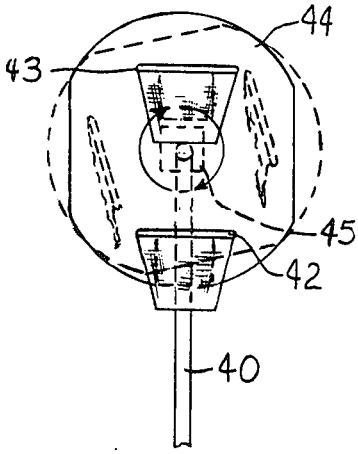
FIG. 7 is a front view showing two goals on a single backboard in which the goals and backboard rotate together around a horizontal axis generally in the plane of the goals.

As shown in FIG. 7, a pair of goals 42 and 43 are mounted one above the other on the same side of a single backboard 44 having the shape of a square with a pair of opposed rounded corners. A suitable drive motor and drive mechanism 45 are appropriately mounted on support post 40 to cause backboard 44 to revolve about its midpoint in a plane parallel with a vertical plane taken through goals 42 and 43. The player must time his shot when the goals are in perpendicular alignment with the shooting line, and when shooting for the goal in the lower position the flight path must be such as to avoid contact with the higher positioned goal.

Figure 10:
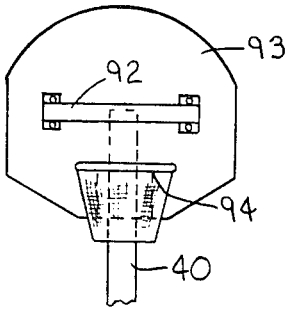
FIG. 10 is a front elevation view and FIG. 11 a side elevation view of a goal-backboard arrangement having a barrier imposed above the goal.
Figure 11:
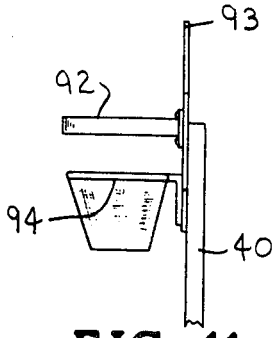

The respective front and side views of FIGS. 10 and 11 illustrate a goal-backboard arrangement in which a bent band member forms a stationary barrier 92 mounted on the backboard 93 above goal 94 and requiring an arch-type shot.

Figure 12:
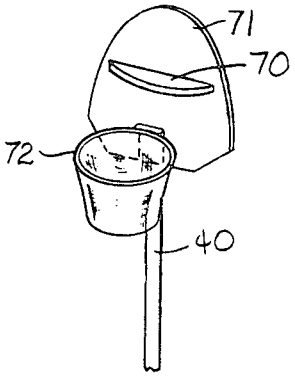
FIG. 12 is a perspective view of a goal-backboard arrangement illustrating another type barrier above the goal.

In FIG. 12, a variation in the shape of the backboard and design of the stationary barrier is illustrated with a solid, half elliptical-shaped barrier 70 mounted slightly above goal 72 on backboard 71 for ball clearance. This type of barrier requires the player to shoot the ball such that it will have a relatively shallow or low trajectory to avoid striking the barrier 70.

Figure 8:
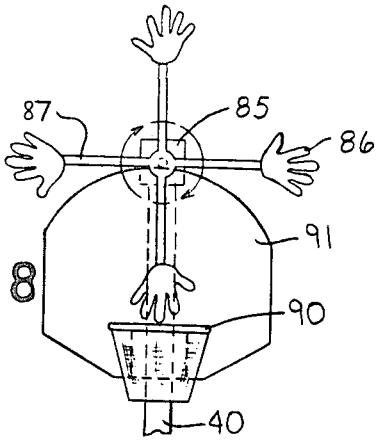
FIG. 8 is a front elevation view of a goal-backboard arrangement in which a set of simulated hands rotate around a horizontal axis above the goal and provide simulated hand barriers.

In FIG. 8, a moving barrier is illustrated in which a motor and drive mechanism 85 mounts four simulated human hands 86 on respective radial extending arms 87 so that hands 86 periodically pass in front of the regulation size goal 90 mounted on a conventional backboard 91. Here, it will be noted that the player is given the vacarious feeling of defensive opposition, and the degree of opposition can, of course, be regulated to some extent by varying the speed and direction of rotation through controls on motor drive 85.

Figure 13:
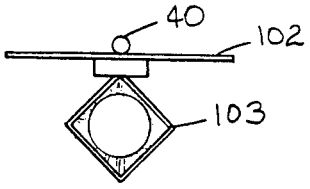
FIG. 13 is a plan view of a goal-backboard arrangement in which the goal is of diamond configuration.
Figure 14:
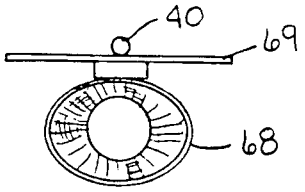
FIG. 14 is a plan view of a goal-backboard arrangement in which the goal is of elliptical configuration.
Figure 15:
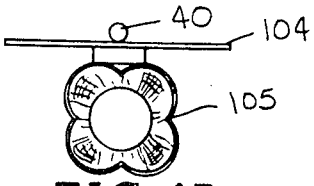
FIG. 15 is a plan view of a goal-backboard arrangement in which the goal is of cloverleaf configuration.
Figure 18:
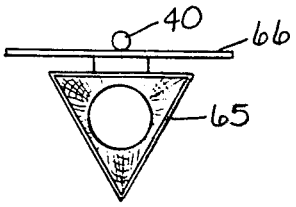
FIG. 18 is a plan view of a goal-backboard arrangement in which the goal is of triangular configuration.

In FIGS. 13, 14, 15 and 18, a different challenge is presented by changing the shape of the goal. FIG. 13 illustrates a diamond-shaped goal 103 mounted on a standard backboard 102. FIG. 14 shows a somewhat elliptical-shaped goal 68 mounted on backboard 69. A cloverleaf-shaped goal 105 mounted on a conventional backboard 104 is shown in FIG. 15. FIG. 18 illustrates a triangular-shaped goal 65 mounted on backboard 66. All the backboards 102, 69, 104 and 66 of FIGS. 13, 14, 15 and 18 are mounted on standard posts 40. While not illustrated in the drawings, other challenging shapes could be used.

Figure 19:
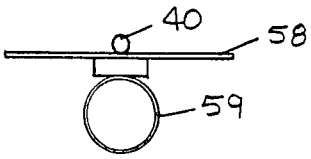
FIG. 19 is a plan view of a type of goal-backboard construction in which the goal is of a reduced size.

In still another type challenge, the dimensions of the goal are reduced such as is shown in FIG. 19 where goal 59 has a standard circular shape but reduced in size is mounted on a conventional backboard 58. Not shown are goals that are larger in diameter than the regulation size goal.

Figure 16:
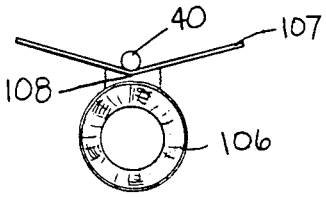
FIG. 16 is a plan view and FIG. 17 a front elevation of a goal-backboard construction wherein the backboard is angled rearward from its centerline.
Figure 17:
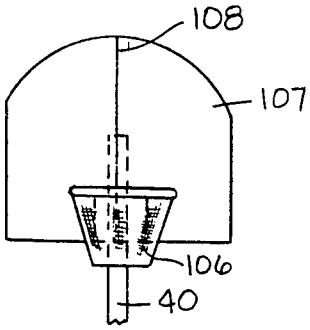

Aside from varying the shape of the goal, further challenges are provided by varying the shape of the backboard upon which the goal is mounted to make bank shots into the goal more difficult. FIG. 16 shows a plan view and FIG. 17 a front view of a goal-backboard arrangement in which the backboard 107 is angled. As seen in these figures, a standard goal 106 is mounted on a molded, one piece backboard 107 which is angled in a direction away from goal 106 from centerline 108. Backboard 107 is mounted on conventional post 40. What is desired in this and all other examples is to provide substantial change in the type and degree of challenge experienced by the player as he moves from one court to the next. While shown as a molded one-piece backboard, it is feasible to construct backboard 107 from two pieces connected together at centerline 108.

Figure 9:
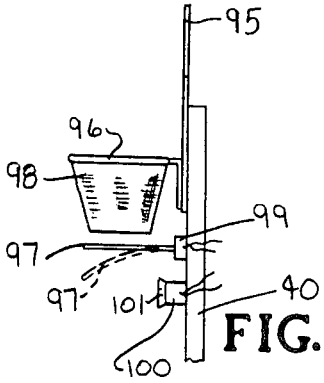
FIG. 9 shows, in side elevation, the positioning of a lever arm beneath the goal which activates a limit switch and an audible device such as a siren through a delay switch as the ball passes through the net of the goal.

In FIG. 9, support post 40 is shown supporting a conventional backboard 95 having a conventional goal 96. However, in this instance a suitable lever arm 97 is placed in the path of the ball as it passes through the net 98 so as to activate a limit switch 99 and a device to stimulate the senses, such as a horn 101, siren or bell, through a suitable delay switch 100 which can be connected in circuit arrangements well known to those skilled in the art to prevent activation of the device 101 which produces a sensory effect more than once per ball passage in the event the ball tends to rebound or otherwise activate the trip lever 97 more than once in the same ball passage sequence.

While not illustrated, the sound device 101 shown in FIG. 9 may constitute a recording device such that in particular courts, the player may be given a recorded compliment such as "Good Shot", "Nice Play", or the like, as a type of reward for overcoming a particularly difficult challenge. On the other hand, device 101 need not be a sound producing device but could be a device for producing other sensory effects, such as visual. For example, a device could be used which would emit a complimentary message in brilliant colors or a simulation of fireworks.

In addition to varying the challenge as described by presenting the player with different types of goal-backboard arrangements, it will also be appreciated that additional variety in challenge can be introduced by adopting rules which require the player to shoot at the goal from an angle or from a great distance. Also, while not illustrated in the drawings, another means for varying the type of challenge can be achieved by rotating the goal-backboard with reference to the shooting line. For example, the goal-backboard can be rotated 45 degrees on either side of the line which is perpendicular to the shooting line so that the face of the backboard assumes an angular relation with regard to the player at the time he shoots. Also, indicia may be provided on the court surface, such as four solid triangular indicias providing the player with an opportunity to select several different stations from which to shoot. In this situation, the scoring rules can be arranged with a variation in the number of points obtained for a particular shot depending from which corner the shot is made.

In summary, it can be seen that the invention provides a type of commercial basketball recreation facility not heretofore available and which gives the opportunity both for individual participation as well as a continuing change in challenge presented the player to simulate the type of challenge placed on the player in the conventional basketball game. Also, the basketball recreational facility of the invention in its layout provides a type of facility which lends itself to available land areas of varying shape. Thus, while the recreational facility of the invention has been described in connection with placement on a rectangular-shaped piece of property, it can be seen that the various sets of courts could be placed in a more elongated array or the courts, instead of being wedge-shaped, as illustrated, could conceivably be in a side-by-side array in which each court is rectangular in shape and the series of courts making up the facility, in this instance, could be arranged side-by-side from the first court of play to the last court of play without loss of any of the basic advantages of the invention in providing a variety in challenge to the player from court-to-court.

What is claimed is:

1. A commercial basketball recreational facility comprising:

(a) an array of basketball courts grouped in spaced-apart sets on a common land area, each set of courts having a plural number of courts and each court having a goal-backboard support means and appropriate fencing shared with adjacent courts on either side thereof; and (b) a set of elevated unique goal-backboard structures for the array of courts with one such unique structure being supported in each court on each said support means at an elevation appropriate to the game of basketball and including among the set of said unique goal-backboard structures at least one such unique goal-backboard structure having a vertical backboard with a conventional basketball goal mounted on a shaft member rotatable with respect to the backboard about a horizontal axis perpendicular to the plane of the backboard and means to rotate said shaft so as to present said goal in a periodically recurring normal horizontal basketball goal position for passage of the ball therethrough.

* * * * *